United States Patent [19]

Ichihara

[11] 3,982,650

[45] Sept. 28, 1976

[54] COLLAPSIBLE CONTAINER

[75] Inventor: Shigeo Ichihara, Matsudo, Japan

[73] Assignee: Dainippon Plastics Co., Ltd., Osaka, Japan

[22] Filed: Oct. 14, 1975

[21] Appl. No.: 622,329

[30] Foreign Application Priority Data

| | | |
|---|---|---|
| Dec. 20, 1974 | Japan | 49-147145 |
| Oct. 19, 1974 | Japan | 49-126370[U] |
| Oct. 22, 1974 | Japan | 49-128182[U] |
| Dec. 20, 1974 | Japan | 49-155333[U] |
| Dec. 20, 1974 | Japan | 49-155334[U] |

[52] U.S. Cl. ..... 220/4 F; 217/12 R; 217/43 R

[51] Int. Cl.[2] ..... B65D 7/00; B65D 9/12

[58] Field of Search ..... 220/4 R, 4 F, 6, 7, 220/75, 76, 337, 341, 342; 217/12 R, 14, 43 R, 65

[56] References Cited

UNITED STATES PATENTS

| | | | |
|---|---|---|---|
| 1,931,397 | 10/1933 | Smith | 217/43 |
| 2,186,743 | 1/1940 | Vaughan | 217/43 |

FOREIGN PATENTS OR APPLICATIONS

| | | | |
|---|---|---|---|
| 1,279,245 | 6/1972 | United Kingdom | 220/6 |

*Primary Examiner*—William Price
*Assistant Examiner*—Steven M. Pollard
*Attorney, Agent, or Firm*—Hubbell, Cohen, Stiefel & Gross

[57] ABSTRACT

A collapsible container with or without a lid for carrying and storing articles comprising at least one side plate formed in its inner surface with recessed portions aligned along one end thereof and each having a vertical pin supported by opposed walls defining the recessed portion, and another adjacent side plate having hinge projections provided on one of its opposite ends adjacent to the first-mentioned side plate. The hinge projections rotatably retain the vertical pins in engagement therewith to render the container completely collapsible. Each of the hinge projections disengageably abuts against an outer wall defining each of the recessed portions to impart increased buckling strength to the container.

9 Claims, 19 Drawing Figures

FIG. 5
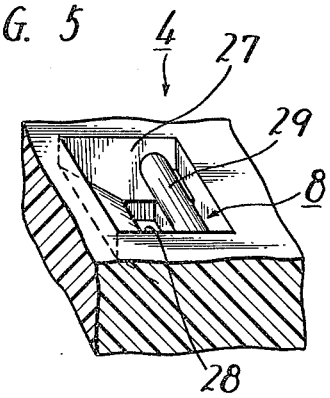
FIG. 6
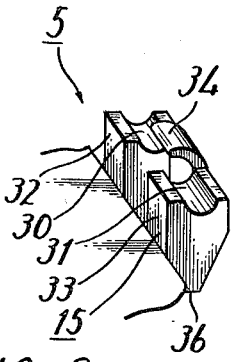
FIG. 7
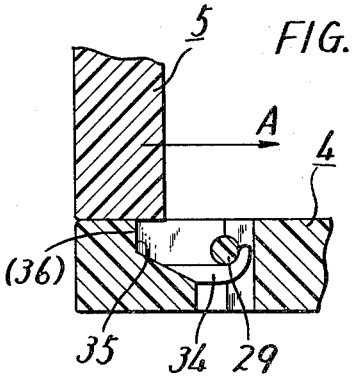
FIG. 8
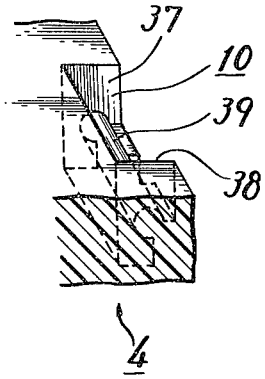
FIG. 9
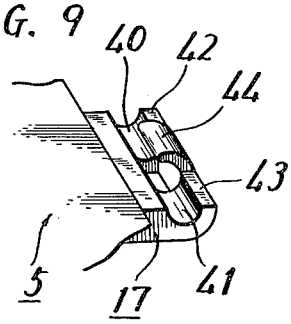
FIG. 10
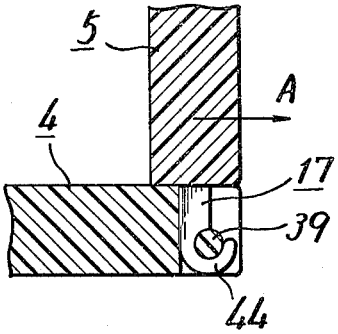
FIG. 11
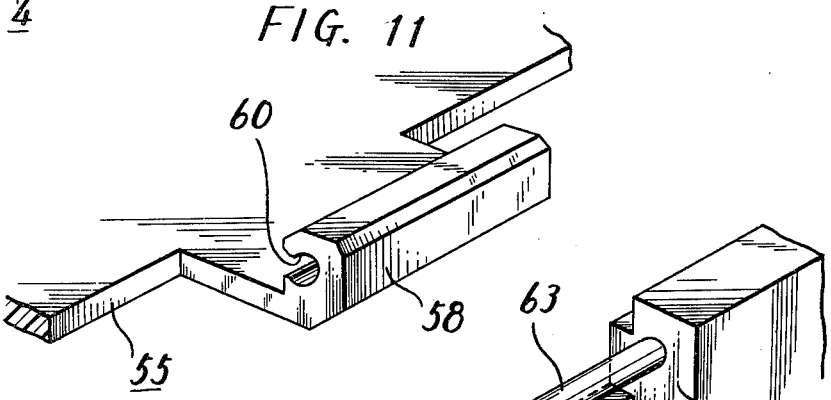
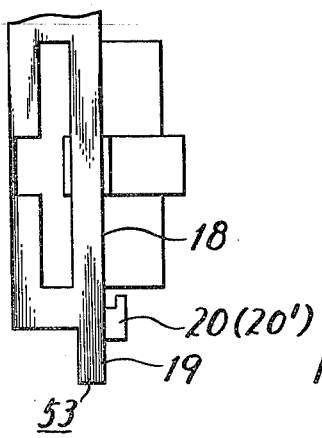
FIG. 12

COLLAPSIBLE CONTAINER

BACKGROUND OF THE INVENTION

1. Field of the Invention

The present invention relates to collapsible containers, and more particularly to containers for use in carrying and storing agricultural products, processed food products and like commercial articles which containers are collapsible for storage when not in use.

2. SUMMARY OF THE INVENTION

A collapsible container having high buckling strength is provided in which the container includes four side plates with the four side plates of the container including one plate formed in its inner surface with recessed portions along one end thereof and another side plate positioned adjacent to the recessed side plate and provided with hinge projections on one end thereof adjacent to the recessed side plate. Each of the recessed portions has a vertical pin supported by opposed walls defining the recessed portion. Each of the hinge projections includes grooved bearing portions which are open substantially toward the direction in which the grooved bearing portions are open when the plates are assembled, defined as "direction A" throughout the specification and claims. In addition, each of the hinge projections includes an elastic piece for rotatably retaining the vertical pin to thereby render the plates connectable into a collapsible assembly.

The hinge projection is adapted for abutting contact with an outer wall defining the recessed portion. This prevents the hinge projection from being easily removed from the recessed portion in a direction opposite to the above defined direction A and, accordingly, imparts increased buckling strength to the container, such as against a force acting thereon to force its side walls outward as when it is subjected to the weight of like containers stacked thereof. This feature further makes it possible to mold the two adjacent side plates separately, to shape both the recessed portion and hinge projection so that they are readily releasable from the molding dies and, consequently, to produce the container from synthetic resin in large quantities. Furthermore, because the hinge projection and the recessed portion are engageable with each other without permitting any part thereof to project from the outer surfaces of the constituent plates, the container is collapsible to a flat shape. In addition, the fact that the position of the grooved bearing portions relative to the inner surface of the side plate formed with the hinge projection is suitable determinable renders the bottom plate efficiently inwardly foldable.

Other features and advantages of the present invention will become apparent from the following description.

As described above, throughout the specification and appended claims, the term "direction A" is defined as the direction in which the grooved bearing portions are open when the plates are assembled, namely the direction inward of the side plate provided with the hinge projection. Accordingly, the hinge projection itself has no counterforce in a direction opposite to the direction A.

The present invention is in no way limited to the preferred embodiments to be described below with reference to the accompanying drawings.

BRIEF DESCRIPTION OF THE DRAWINGS

FIG. 5 is an enlarged view of the portion of FIG. 2 identified by I thereon;

FIG. 6 is an enlarged view of the portion of FIG. 3 identified by II thereon as it is seen from the rear;

FIG. 7 is a view in horizontal section showing the parts I and II are connected together;

FIG. 8 is an enlarged view showing the portion of FIG. 2 identified as III thereon;

FIG. 9 is an enlarged view showing the portion of FIG. 3 identified as IV thereon;

FIG. 10 is a view in horizontal section showing the parts III and IV as connected together;

FIG. 11 is a view illustrating the construction of the portion of FIG. 1 identified as VI thereon;

FIG. 12 is a side elevation showing the portion of FIG. 3 identified as V;

DETAILED DESCRIPTION OF THE PREFERRED EMBODIMENTS

Figure 1:
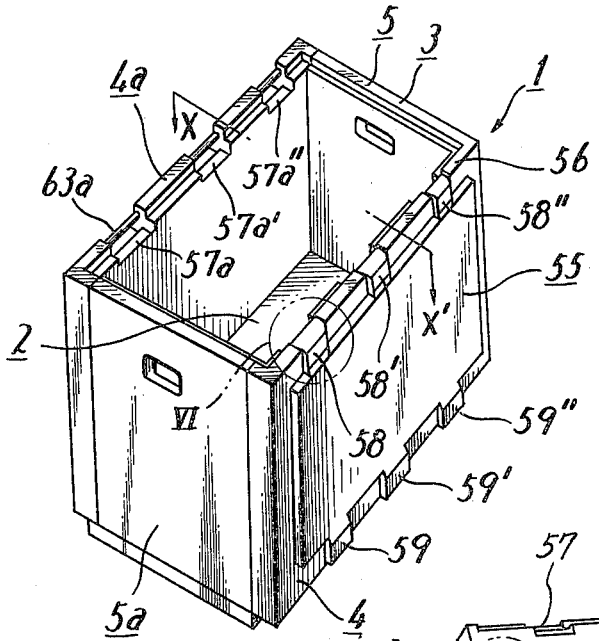
FIG. 1 is a perspective view showing a collapsible container embodying the present invention.
Figure 2:
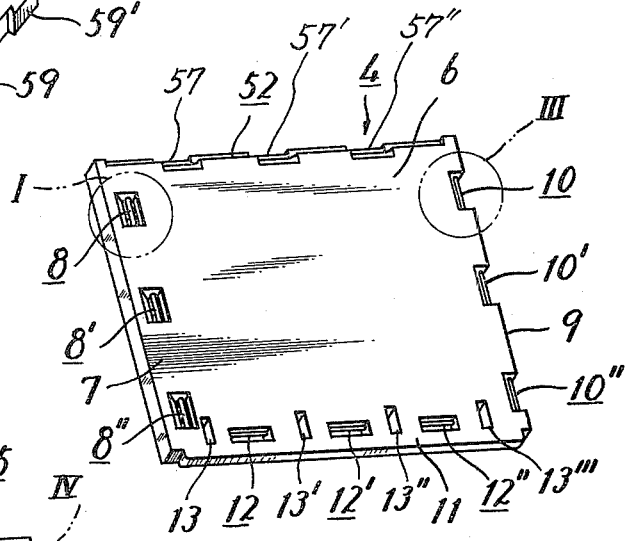
FIGS. 2 to 4 are perspective views showing a long side plate, a short side plate and a rectangular bottom plate, respectively, before they are assembled into the container of FIG. 1.
Figure 3:
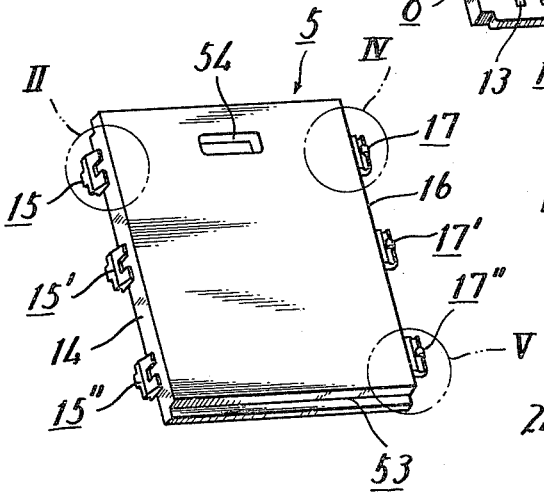

Referring now to the drawings in detail, and initially to FIGS. 1 to 3, a collapsible container 1 for carrying and storing articles comprises a rectangular lid 55 (shown in the hinged open position), a rectangular bottom plate 2 and a side plate assembly 3 surrounding the bottom plate 2. The side plate assembly 3 is preferably a rectangular configuration which includes opposed long side plates 4, **4*a* connected to the long side edges of the rectangular bottom plate 2 and opposed short side plates 5, 5*a* connected to the short side edges of the bottom plate 2. The long side plate 4 (FIG. 2) is formed in its inner surface 6 with recessed portions 8, 8′, 8″ arranged in vertical alignment along its one end 7 and with recessed portions 10, 10′, 10″ vertically aligned along the other end 9. The long side plate 4 further has recessed portions 57, 57′, 57″ in its upper edge 56 and horizontally aligned recessed portions 12, 12′, 12″ and similarly arranged retaining portions 13, 13′, 13″ in the inner surface 6 close to its lower edge 11. The long side plate 4*a* has exactly the same construction as the long side plate 4** described above and is defined by identical reference numerals, followed by the letter *a*, for like elements with respect to side plate 4. The short side plate 5 (FIG. 3) has hinge projections 15, 15′, 15″ engaged in the recessed portions 8, 8′, 8″ and provided in vertical alignment on one end 14 adjacent to the long side plate 4. On the other end 16, the short side plate 5 has vertically aligned hinge projections 17, 17′, 17″ engaged in the recessed portions 10, 10′, 10″. The plate 5 is further formed with retaining portions 20, 20′ on its inner surface 18 close to the lower edge 19 thereof (see FIG. 12). The short side plate 5*a* has the same construction as the short side plate 5 described above and is defined by identical reference numerals, followed by the letter *a*, for like elements with respect to side plate 5.

Figure 4:
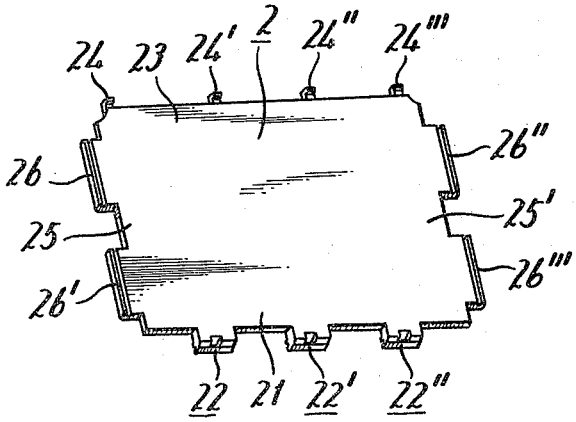
Figure 13:
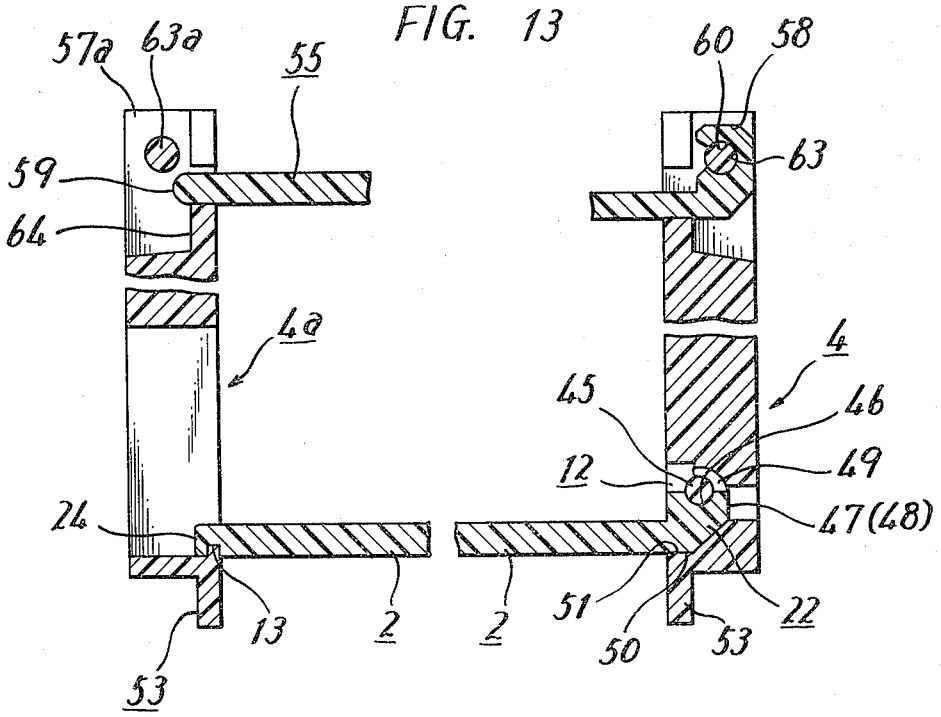
FIG. 13 is a view in section taken along the line X-X′ in FIG. 1 and partly broken away.

The rectangular lid 55 has on one side edge hinge projections 58, 58′, 58″ engaging in the recessed portions 57, 57′, 57″ in the upper edge 56 of the long side plate 4. Locking portions 59, 59′, 59″ formed at another side edge of the lid 55 opposed to the above-mentioned side edge are engageable in the recessed portions 57*a*, 57′*a* 57″*a* of the long side plate 4*a* to hold the lid 55 in its closed position (FIG. 13). One long side edge 21 of the short bottom plate 2 (FIG. 4) connected to the long side plate 4 is provided with hinge projections 22, 22′, 22″ engaged in the recessed portions 12, 12′, 12″. The other long side edge 23 of the bottom plate 2 has engaging portions 24, 24′, 24″, 24‴ engaged in the retaining portions 13, 13′, 13″, 13‴. The other two short side edges 25 and 25′ of the plate 2 are provided with engaging portions 26, 26′ and 26″, 26‴ engaged in the retaining portions 20, 20′ and 20′, 20, respectively, of the short side plates 5 and 5*a*, respectively (see FIGS. 4 and 12).

Accordingly, after the lid is opened, the collapsible container can be separated into its constituent plates by disengaging the hinge projections from the mating recessed portions, and the engaging portions from the mating retaining portions.

The collapsible container 1 is preferably made of plastic, such as preferably high-density polyethylene. More specifically the four kinds of plates, i.e., the long side plates, short side plates, rectangular lid and rectangular bottom plate, are each preferably integrally molded from high-density polyethylene by injection molding. The molded plates are assembled into the container 1 measuring by way of example, about 340 mm. × 270 mm. × 277 mm. (height).

With reference to FIG. 11, the hinge projection 58 of the rectangular lid 55 projects upward from the upper surface of the lid in its closed position and is formed with an inwardly open grooved bearing portion 60, whilst the recessed portion 57 of the long side plate 4 is provided with a horizontal pin 63 extending longitudinally of the plate 4 and supported by opposed walls 61, 62 defining the recessed portion 57. The pin 63 is preferably elastically forced into the bearing groove 60, due to the resiliency or elasticity of the plastic, whereby the lid is pivotally supported so as to be openable outward through an angle of about 270°. The hinge projections 58′, 58″ of the rectangular lid 55 and the recessed portions 57′, 57″ preferably have exactly the same constructions as above and will not be described in greater detail hereinafter.

The locking portion 59 of the lid 55 has a round end, such that when the lid is closed, the round end first comes into contact with a horizontal pin 63*a* provided in the recessed portion 57*a* of the long side plate 4*a* and the locking portion 59 is then placed in position with further application of depressing force. The recessed portion 57*a* of the long side plate 4*a* has a cutout 64. To open the lid 55, fingers are placed into the cutout 64, and the locking portion 59 is pushed upward from the recessed portion 57*a*. Thus, the lid in its locked position is outwardly openable through an angle of about 270° (see FIG. 13).

Referring now to FIGS. 5 to 7, the recessed portion 8 of the long side plate 4 has a vertical pin 29 supported by upper and lower walls, 27 28 defining the recessed portion. The hinge porjection 15 of the short side plate 5 has upper and lower bearing portions 32, 33 formed in their ends in opposed relation to the pin 29, with vertical grooves 30, 31 which are open substantially inward (i.e., in the direction of arrow A) when the parts are to be assembled. Provided between the bearing portions 32 and 33 is a tongue-like elastic or resilient piece 34 to rotatably retain the vertical pin 29 in elastic or resilient contact with the bearing portions 32, 33. A substantially vertical outer wall 35 defining the recessed portion 8 is adapted to be brought into face-to-face contact with an abutting portion 36 of the hinge projection 15 when the container is to be assembled in shape. The recessed portions 8′, 8″ and hinge projections 15′, 15″ preferably have exactly the same constructions as above and will not be described in greater detail hereinafter. The recessed portion 10 of the long side plate 4, like the recessed portion 8 described above, preferably has a vertical pin 39 supported by upper and lower walls 37, 38 defining the recessed portion 10 (see FIG. 8). The hinge projection 17 of the short side plate 5 preferably has upper and lower bearing portions 42, 43 formed in their ends in opposed relation to the pin 39, with vertical grooves 40, 41. Between the bearing portions 42 and 43, there is provided a tongue-like elastic or resilient piece 44 to rotatably retain the vertical pin 39 in elastic or resilient contact with the bearing portions 42, 43 (see FIGS. 8 to 10). The recessed portions 10′, 10″ and hinge projections 17′, 17″ preferably have exactly the same constructions a above and will not be described in greater detail hereinafter.

The construction of the recessed portions 12, 12′, 12″ of the long side plate 4 and the construction of the hinge projections 22, 22′, 22″ of the rectangular bottom plate 2 as related to the former are preferably exactly the same as those of the recessed portion 8 and the hinge projection 15, respectively and will not be described in greater detail hereinater. Suffice it to say that, for example, the recessed portion 12 has a horizontal pin 45 extending between the opposed side walls thereof, and the hinge projection 22 has bearing portions 47, 48 formed with upwardly open horizontal grooves 46 and an elastic or resilient piece 49. The hinge projection 22 and an abutting portion 50 are in face-to-face contact with a lower wall 51 defining the recessed portion 12. The engaging portion 24 is preferably in the form of a downwardly bent projection in engagement with the retaining portion 13 which is preferably in the form of an upwardly bent projection (see FIG. 13). The engaging portion 26 and retaining portion 20 preferably have like constructions and will not be described in greater detail hereinafter.

Figure 15:
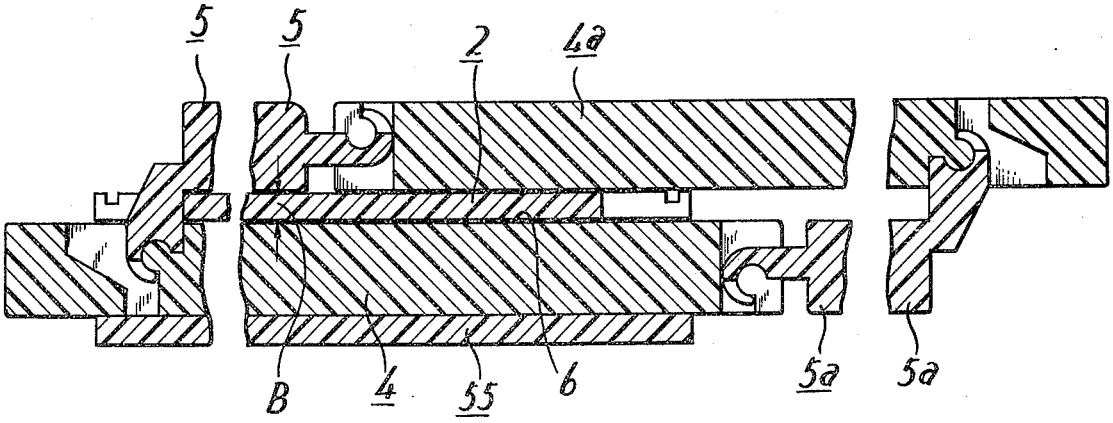
FIG. 15 is a view in horizontal section of the container of FIG. 1 in its collapsed position.

When the container is in its collapsed position, the distance B between the inner surfaces of the opposed plates, for example between the inner surface 6 of the long side plate 4 and the inner surface of the short side plate 5 is preferably approximately equal to the thickness of the rectangular bottom plate 2 (see FIG. 15).

As shown and preferred in FIGS. 2, 3 and 13, stepped portions 52 are preferably formed continuously in the upper edge of the side plate assembly 3, and projections 53 are preferably formed on the lower edge of the same in corresponding relation to the stepped portions 52. These portions 52 preferably serve to determine the position of the containers 1 when they are stacked.

A handle opening 54 is preferably formed in an upper portion of each of the short side plates 5, 5*a*.

The rectangular lid 55 of the collapsible container 1 prevents the articles placed therein from dropping or being stolen. This can be assured more reliably by the provision of the locking portion 59 on the lid 55 and the horizontal pin 63*a* in the recessed portion 57 of the long side plate 4*a* which cooperate to lock the lid.

Figure 14:
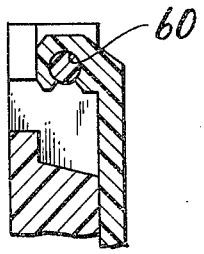
FIG. 14 is a fragmentary view in section showing a rectangular lid in its fully open position.

To collapse the container 1, the rectangular bottom plate 2 is inwardly folded after the rectangular lid 55 has been pivotally moved through about 270° to an open position as shown in FIG. 1, and the long side plate 4 and the short side plate 5 are folded toward each other, with the long side plate 4*a* and the short side plate 5*a* similarly placed one over the other. In this way the container 1 is collapsible with ease. Since the rectangular lid 55 is foldable over the outer surface of the side wall assembly (see FIG. 14), with the rectangular bottom plate 2 interposed between the opposed parts of the collapsed side plate assembly 3 in a compact flat state without any projection, empty containers thus completely collapsible can be transported in large quantities. Although collapsible, the container which has such compact construction is inexpensive to manufacture. If desired, the container 1 described above need not be provided with the lid 55, in which case the container 1 is still similarly completely collapsible.

When the collapsible container 1 is in use, the vertical grooves 30, 31 in the bearing portions 32, 33 at the junction of the long side plate 4 and the short side plate 5 (or the long side plate 4*a* and the short side plate 5*a*) are open substantially inward (as indicated by the arrow A), and the open grooved portions are retained in position only by the elastic or resilient piece 34 having very low resistance to a force in an opposite outward direction. Consequently the elastic or resilient piece 34 is unable to withstand a force to be exerted on the long side plate 5 to force the plate outward as when the containers are stacked. However, the face-to-face contact of the abutting portion 36 of the short side plate 5 with the outer wall 35 of the long side plate 4 affords resistance to this outward force. This gives greatly increased buckling strength to the container, overcoming the reduction of strength resulting from its collapsiblity to make the container tough and strong.

The long side plates 4, 4*a*, short side plates 5, 5*a*, rectangular lid 55 and rectangular bottom plate 2 can be assembled into the collapsible container 1 simply by elastically or resiliently fitting the hinge projections into the recessed portions and engaging the engaging portions with the retaining portions in a snap-fit type of arrangement.

The collapsible container 1 is composed of only four kinds of plates and is suited for mass production, since the plates are easily moldable from synthetic resin and have such shapes that they are readily releasable from the dies. The container is therefore very inexpensive to manufacture. Inasmuch as the recessed portions, hinge projections and other fitting portions are almost unexposed, the container 1 having the lid is least susceptible to damage and is accordingly durable.

The grooved bearing portions have been explained as being open substantially inward (i.e., in the direction A) when the parts are assembled. This means that the grooved portions are open in such direction that they substantially fail to withstand the outward force to be applied to the side plate concerned. Thus, the direction referred to above needs to involve some range of directions including the inward direction as opposed to the outward direction. Particularly when the plates are molded from synthetic resin, consideration must be given to a relatively large range of directions depending on the elasticity or resiliency of the material. It is this elasticity or resiliency of the material which enables the snap-fit connections referred to above.

The outer wall defining the recessed portion against which the hinge projections bears must preferably fulfill the requirement that it is substantially capable of preventing the outward movement of the side plate, so that the outer wall need not necessarily be vertical with respect to the outward direction. However, the outer wall is preferably substantially vertical with respect to the outward direction, to such extent that it will not entail difficulties in molding as well as in the pivotal folding movement of the side plate. It is also presently preferred that the outer wall be adapted for face-to-face contact with the hinge projection.

Although the bottom plate of the foregoing embodiment is generally rectangular, a square bottom plate is usable, in which case there is still the necessity of employing at least two kinds of said plates corresponding to the long and short side plates.

Preferably by way of example, the collapsible container 1 may be formed from, as opposed to high-density polyethylene, polypropylene and like synthetic resins, or any other materials providing the desired properties for the container. Furthermore, the container may have varying dimensions in accordance with its use, and the exemplary dimensions of the embodiment are not meant to be limiting. Although the illustrated embodiment includes three recessed portions, hinge projections or locking portions along each of the desired edges or ends of the plates, the number of such portions can be determined as required, if the corresponding number of indentations can be formed in the rectangular bottom plate which indentations must be formed to render the bottom plate free of interference with the recessed portions and hinge projections when the plates are folded. The same is true of the grooved bearing portions and the elastic or resilient pieces.

In order to conserve material, each of the long side plates, short side plates, etc. may be composed of a relatively thin inner wall and a similarly thin rib extending outwardly from the four side edges of the wall.

Figure 16:
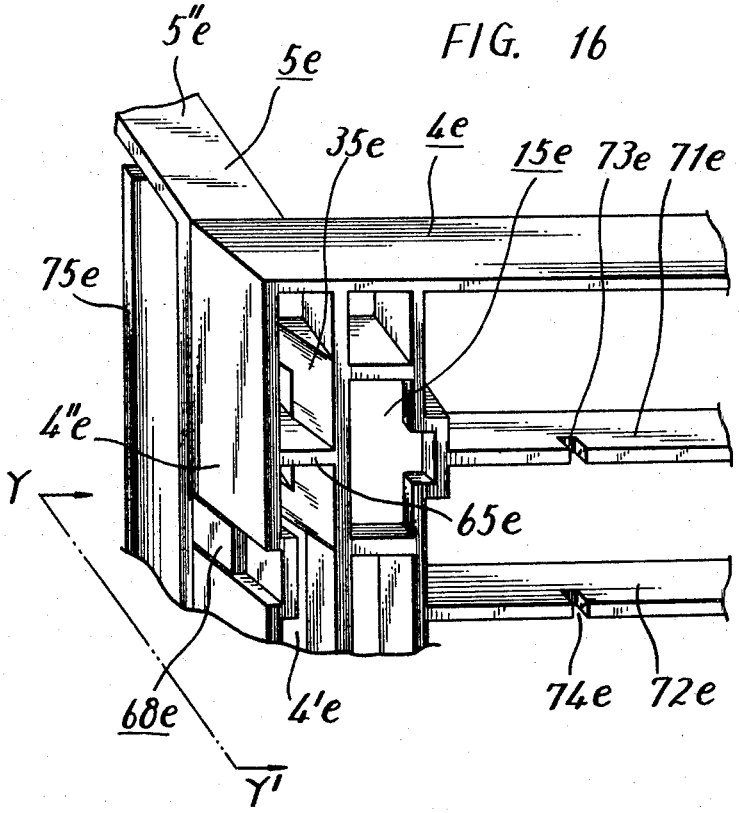
FIG. 16 is a fragmentary perspective view of another embodiment of the container of FIG. 1 equipped with no lid to show its short side plate as related to the long side plate thereof.
Figure 17:
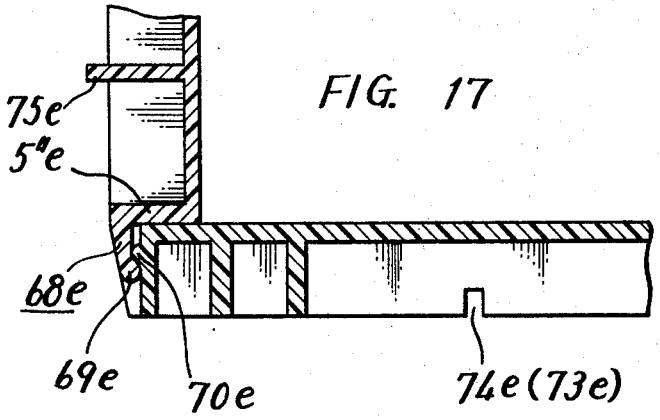
FIG. 17 is a view in section taken along the line Y-Y′ of FIG. 16.
Figure 18:
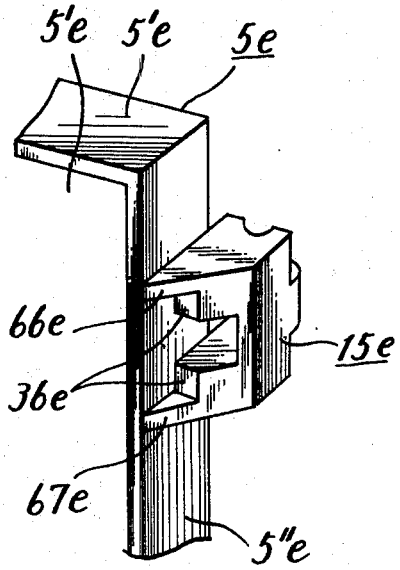
FIG. 18 is a perspective view showing the hinge projection of the short side plate of the embodiment of FIG. 16.
Figure 19:
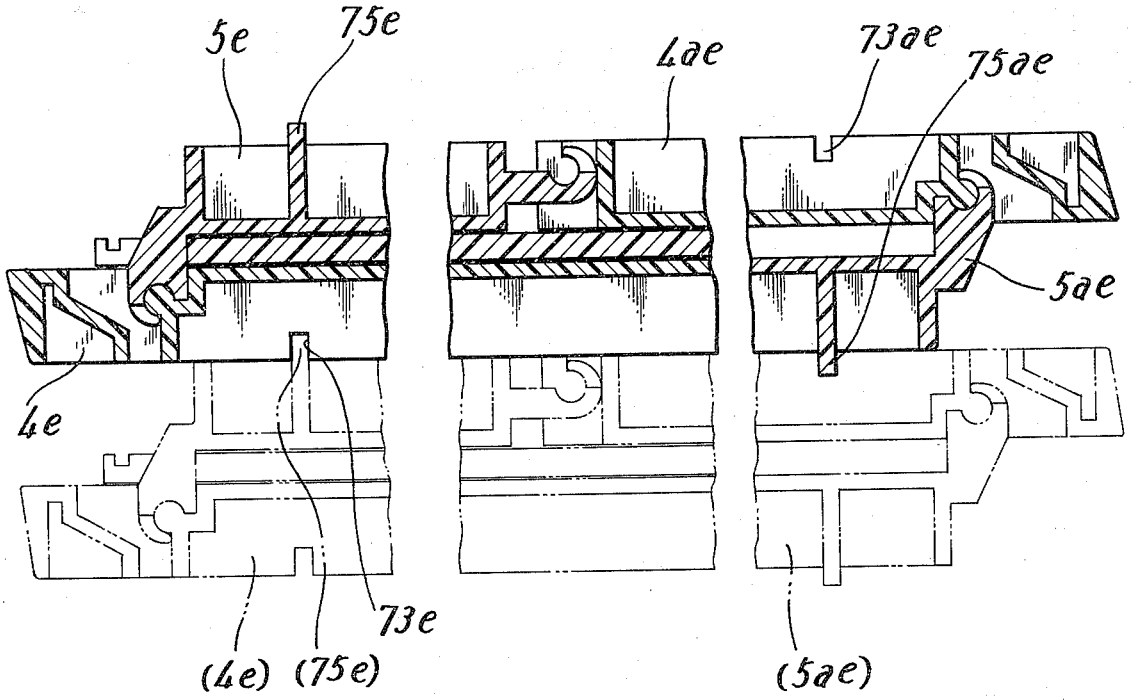
FIG. 19 is a view in section showing the container of FIG. 16 as it is placed on another like container.

With reference to FIGS. 16 to 18, a long side plate 4*e* is made up of an inner wall 4'*e* and a rib 4''*e* extending outwardly from the four side edges of the wall 4'*e*. The outer wall 35*e* which is adapted for face-to-face contact with the abutting portions 36*e* of hinge projection 15*e* of the short side plate 5*e* is likewise of a small thickness. Accordingly, a reinforcing rib 65*e* is preferably provided for interconnecting the outer wall 35*e* and the rib 4'' to enable the short side plate 5*e* to satisfactorily withstand an outward force to be exerted on the plate 5*e*.

Since the hinge projection 15*e* is also subjected to a very great force in preventing the short side plate 5*e* from outward deflection, it is advantageous to provide reinforcing ribs 66*e*, 67*e* for connecting the upper and lower ends of the abutting portions 36*e* to the side rib 5″*e* of the plate 5*e*.

Although the recessed portions and the hinge projections described above give exceedingly high buckling strength to the collapsible container, the square or rectangular bottom plate or the bottom plate and similarly shaped lid alone act to prevent the container from collapsing during use. For this reason, it is desirable that the short side plate 5*e* be provided with a locking pawl 68*e* extending horizontally from its rib 5″*e* (see FIGS. 16 to 17). The locking pawl 68*e* has a protrusion 69*e*. The rib 4″*e* of the long side plate 4*e* preferably has a recessed portion having a protrusion 70*e* for engagement with this protrusion 69*e*.

Not infrequently, collapsed containers having no lids are stacked for storage or transportation. To prevent such stacked containers from slipping off, it is preferable to form cutouts 73*e*, 74*e* in horizontal ribs 71*e*, 72*e*, other than the ribs 4″*e*, (4*a*″*e*) at the upper and lower edges, on the outer surface of the long side plates 4*e*, 4*ae*, and to provide vertical ribs 75*e*, 75*ae* on the adjacent side plates 5*e*, 5*ae*, so that the vertical ribs are engageable in the cutouts 72*e*, 74*e* when the collapsed containers are stacked.

It is to be understood that the above-described embodiments of the invention are merely illustrative of the principles thereof and that numerous modifications and embodiments of the invention may be derived within the spirit and scope thereof.

What is claimed is:

1. A collapsible container comprising a substantially rectangular bottom plate and side plates surrounding the bottom plate, at least one of the side plates being formed in its inner surface with a plurality of recessed portions aligned along one end thereof and each having a vertical pin supported by opposed walls defining the recessed portion, another one of the side plates being adjacent to the side plate and provided with a plurality of hinge projections positions in corresponding relation to an engaged in the recessed portions respectively, each of the hinge projections including grooved bearing portions open substantially toward a direction A in which the grooved bearing portions are open when said plates are assembled to comprise said container in its uncollapsed state and an elastic piece for rotatably retaining the vertical pin, each of the hinge projections releasably abutting against an outer wall defining each of the recessed portions.

2. A collapsible container as defined in claim 1 wherein:

i. each of two opposed long side plates among the side plates is formed in its inner surface with a plurality of recessed portions aligned along one end thereof and each having a vertical pin supported by opposed walls defining the recessed portion, each of two short side plates adjacent to the long side plates being provided with a plurality of hinge projections positioned in corresponding relation to and engaged in the recessed portions respectively, each of the hinge projections including grooved bearing portions open substantially toward the direction A and an elastic piece for rotatably retaining the vertical pin, each of the hinge projections releasably abutting against an outer wall defining each of the recessed portions, and ii. each of the two long side plates is formed in its inner surface with a plurality of recessed portions aligned along the other end thereof and each having a vertical pin supported by opposed walls defining the recessed portion, each of the two short side plates adjacent to the long side plates being provided with a plurality of hinge projections positioned in corresponding relation to and engaged in the recessed portions respectively, each of the hinge projections including grooved bearing portions open substantially toward a direction opposite to the direction A and an elastic piece for rotatably retaining the vertical pin.

3. A collapsible container as defined in claim 1 wherein one of two opposed long side plates among the side plates is formed in its inner surface with a plurality of recessed portions aligned along the lower edge thereof and each having a horizontal pin supported by opposed walls defining the recessed portion, the other long side plate being formed in its inner surface with a plurality of retaining portions aligned along the lower edge thereof, the bottom plate being provided on one of its opposite edges with a plurality of hinge projections each including substantially upwardly open grooved bearing portions and an elastic piece for rotatably retaining each of the horizontal pins, each of the hinge projections of the bottom plate releasably abutting against a lower wall defining each of the recessed portions along the lower edge, the other edge of the bottom plate being provided with engaging portions disengageably in engagement with the retaining portions.

4. A collapsible container as defined in claim 1 wherein:

i. each of two opposed long side plates is formed in its inner surface with recessed portions aligned along each of the opposite ends thereof and each having a vertical pin supported by opposed walls defining the recessed portion, one of the long side plates being formed in its inner surface with recessed portions aligned along the lower edge thereof and each having a horizontal pin supported by opposed walls defining the recessed portion, the other long side plate being formed in its inner surface with retaining portions aligned along the lower edge thereof, ii. each of two opposed short side plates is provided on its opposite ends with hinge projections each including grooved bearing portions and an elastic piece to rotatably retaining each of the vertical pins, the grooved bearing portions on one of the opposite ends being open substantially toward the direction A, the grooved bearing portions on the other end being open substantially toward a direction opposite to the direction A, outer walls defining the recessed portions along one end of each of the long side plates being disengageably in abutting contact with the corresponding hinge projections respectively, iii. the bottom plate is provided on one edge thereof with hinge projections each including substantially upwardly open grooved bearing portions and an elastic piece for rotatably retaining each of the horizontal pins, each of the hinge projections of the bottom plate releasably abutting against a lower wall defining each of the recessed portions along the lower edge of the long side plate, and iv. a predetermined distance B between the inner surfaces of the long and short side plates, said distance B being substantially equal to the thickness of the bottom plate when the container is in its collapsed state.

5. A collapsible container as defined in claim 1 wherein:

i. each of two opposed long side plates is formed in its inner surface with recessed portions aligned along each of the opposite ends thereof and each having a vertical pin supported by opposed walls defining the recessed portion, one of the long side plates being formed in its inner surface with recessed portions aligned along the lower edge thereof and each having a horizontal pin supported by opposed walls defining the recessed portion, the other long side plate being formed in its inner surface with retaining portions aligned along the lower edge thereof, one of the long side plates being formed in its upper edge with recessed portions each having a horizontal pin extending longitudinally thereof and supported by opposed walls defining the recessed portion, ii. each of two opposed short side plates is provided on its opposite ends with hinge projections each including grooved bearing portions and an elastic piece to rotatably retaining each of the vertical pins, the grooved bearing portions on one of the opposite ends being open substantially toward the direction A, the grooved bearing portions on the other end being open substantially toward a direction opposite to the direction A, outer walls defining the recessed portions along one end of each of the long side plates being disengageably in abutting contact with the corresponding hinge projections respectively, iii. the bottom plate is provided on one edge thereof with hinge projections each including substantially upwardly open bearing grooved portions and an elastic piece for rotatably retaining each of the lower horizontal pins, each of the hinge projections of the bottom plate releasably abutting against a lower wall defining each of the recessed portions along the lower edge of the long side plate, iv. the container includes a rectangular lid formed in a longer edge thereof with hinge projections each having a grooved bearing portion elastically fitted to and supported by the upper horizontal pin on one of the long side plates, the lid thereby being made outwardly movable to its open position through an angle of about 270°, and v. a predetermined distance B between the inner surfaces of the long and short side plates, said distance B being substantially equal to the thickness of the bottom plate when the container is in its collapsed state.

6. A collapsible container as defined in claim 1 wherein:

i. each of two opposed long side plates is formed in its inner surface with recessed portions aligned along each of the opposite ends thereof and each having a vertical pin supported by opposed walls defining the recessed portion, one of the long side plates being formed in its inner surface with recessed portions aligned along the lower edge thereof and each having a horizontal pin supported by opposed walls defining the recessed portion, the other long side plate being formed in its inner surface with retaining portions aligned along the lowr edge thereof, each of the long side plates being formed in its upper edge with recessed portions each having a horizontal pin extending longitudinally thereof and supported by opposed walls defining the recessed portion, ii. each of two opposed short side plates is provided on its opposite ends with hinge projections each including grooved bearing portions and an elastic piece to rotatably retaining each of the vertical pins, the grooved bearing portions on one of the opposite ends being open substantially toward the direction A, the grooved bearing portions on the other end being open substantially toward a direction opposite to the direction A, outer walls defining the recessed portions along one end of each of the long side plates being disengageably in abutting contact with the corresponding hinge projections respectively, iii. the bottom plate is provided on one edge thereof with hinge projections each including substantially upwardly open bearing grooved portions and an elastic piece for rotatably retaining each of the lower horizontal pins, each of the hinge projections of the bottom plate releasably abutting against a lower wall defining each of the recessed portions along the lower edge of the long side plate, iv. the container includes a rectangular lid formed in one of opposed longer edges thereof with hinge projections each having a grooved bearing portion elastically fitted to and supported by the upper horizontal pin on one of the long side plates, the lid thereby being made outwardly movable to its open position through an angle of about 270°, the lid being provided on the other longer edge thereof with locking portions engageable with the upper horizontal pins on the other long side plate, and v. a predetermined distance B between the inner surfaces of the long and short side plates, said distance B being substantially equal to the thickness of the bottom plate when the container is in its collapsed state.

7. The collapsible container as defined in claim 1 wherein one of the side plates is composed of an inner wall and a rib extending outward from the four side edges of the inner wall, the inner wall being formed along its one edge with recessed portions, another one of the side plates being adjacent to the side plate and provided with hinge projections positioned on one edge surface thereof in corresponding relation to the recessed portions, the hinge projections being engaged in the recessed portions respectively, an outer portion of each of the hinge projections facing toward a direction opposite to the engaging direction further being releasably in abutting contact with a wall defining part of each of the recessed portions, the recessed portion-defining wall being connected to the rib by a reinforcing rib.

8. A collapsible container as defined in claim 1 wherein one of the side plates is composed of an inner wall and a rib extending outward from the four side edges of the inner wall, the inner wall being formed along its one edge with recessed portions, another one of the side plates being adjacent to the side plate and provided with hinge projections positioned on one edge surface thereof in corresponding relation to the recessed portions, the hinge projections being engaged in the recessed portions respectively, an outer portion of each of the hinge projections facing toward a direction opposite to the engaging direction further being releasably in abutting contact with a wall defining part of each of the recessed portions, the outer portion of the hinge projection being provided with a reinforcing rib supported by the edge surface.

9. A collapsible container as defined in claim 1 wherein said substantially rectangular bottom plate is substantially square.

* * * * *